United States Patent [19]

Honda et al.

[11] Patent Number: 4,876,839

[45] Date of Patent: Oct. 31, 1989

[54] APPARATUS FOR APPLYING SEAL-STRIPS TO PACKAGES TRAVELLING ON A CONVEYOR

[75] Inventors: Sumio Honda; Taizo Ogata, both of Chiba; Tadao Etani, Tokyo, all of Japan

[73] Assignee: Japan Tobacco Inc./Tokyo Automatic Machinery Works Ltd., Tokyo, Japan

[21] Appl. No.: 136,541

[22] Filed: Dec. 22, 1987

[30] Foreign Application Priority Data

Dec. 25, 1986 [JP] Japan ..... 61-201923

[51] Int. Cl.[4] ..... B65C 9/02; B65C 9/22

[52] U.S. Cl. ..... 53/137; 53/520; 493/334; 156/521

[58] Field of Search ..... 53/137, 415, 520; 493/334, 344, 919; 156/521, 568, 578

[56] References Cited

U.S. PATENT DOCUMENTS

| | | | |
|---|---|---|---|
| 3,284,270 | 11/1966 | Noll et al. | 156/521 X |
| 3,751,324 | 8/1973 | Enskat | 156/521 |
| 3,756,899 | 9/1973 | Von Hofe et al. | 156/521 |
| 4,589,943 | 5/1986 | Kimball et al. | 156/521 X |
| 4,620,891 | 11/1986 | Applegate et al. | 53/137 X |

*Primary Examiner*—James F. Coan

*Attorney, Agent, or Firm*—Sandler & Greenblum

[57] ABSTRACT

Apparatus for attaching seal-strip segments to individual packages, where the segments are in the form of a strip having opposed surfaces, includes a transfer element moveable periodically between a receiving position for receiving a segment from a supply thereof and a transfer position for transferring the segment. The transfer element releasably holds a segment with one surface thereof in contact with the element. A rotatable turret is provided having a plurality of stations at equal angular positions about the axis of rotation of the turret, each station having a support surface for supporting a segment. Rotation of the turret is synchronized with movement of the transfer element such that, during one revolution of the turret, a different one of the stations is operatively associated with the transfer element each time the latter moves to its transfer position. At each station, a holder is made effective when the station is operatively associated with the transfer element for effecting a transfer of a segment from the transfer element to the station such that the other surface of the segment is held in contact with the support surface of the station and the opposite surface is exposed. An adhesive applicator is used to apply adhesive to the exposed surface of the segments held by the stations. Finally, the turret has an angular position at which a surface of a package tangentially contacts a station for adhering a segment held thereon to the package.

11 Claims, 4 Drawing Sheets

APPARATUS FOR APPLYING SEAL-STRIPS TO PACKAGES TRAVELLING ON A CONVEYOR

TECHNICAL FIELD

This invention related to apparatus for applying seal-strips to packages travelling along a conveyor, and more particularly to packages of cigarettes.

BACKGROUND ART

Certain goods, for example cigarettes, are packed in a flat, rectangularly shaped package whose width is less than its length, and require seal-strip segments to be connected across the top of each package with the free ends of the segment adhered to opposite sides of a package Conventionally, such segment extends in the lengthwise direction of a package. Using automatic packaging equipment, the packages are conveyed in a direction perpendicular to the length of each package past a station at which a segment is adhered to one side of each package. Conventionally, the line of packages moves intermittently; and segments are applied to the packages when the line is stationary.

It is therefore an object of the present invention to provide a new and improved apparatus for applying seal-strip segments to packages travelling along a conveyor while the packages are moving.

DISCLOSURE OF INVENTION

Apparatus according to the present invention provides for attaching seal-strip segments to individual packages where the segments are in the form of strips having opposed surfaces. The apparatus to the present invention comprises a transfer element moveable periodically between a receiving position for receiving a segment from a supply thereof, and a transfer position for transferring the segment. The transfer element includes means for releasably holding a segment with one surface thereof in contact with the element. The invention further includes a rotatable turret having a plurality of stations at equal angular positions relative to the axis of rotation of the turret, each station having a support surface for supporting a segment. Means are provided for rotating said turret in synchronism with movement of the transfer element such that, during one revolution of the turret, a different one of the stations is operatively associated with the reference element each time the latter moves to its transfer position. Holding means are provided at each station made effective when the latter is operatively associated with the transfer element for effecting a transfer of a segment from the transfer element to the station such that the other surface of the segment is held in contact with the support surface of the station. An adhesive applicator is provided for applying adhesive to the other surface of the segments held by the stations as the latter moves past the applicator during rotation of the turret. Finally, the turret has an angular position at which a surface of a package tangentially contacts a station for adhering the segment there on to the package while the package is moving past the turret.

BRIEF DESCRIPTION OF DRAWINGS

An embodiment of the present invention is shown in the accompanied drawings wherein.

BEST MODE OF OPERATION

Figure 1:
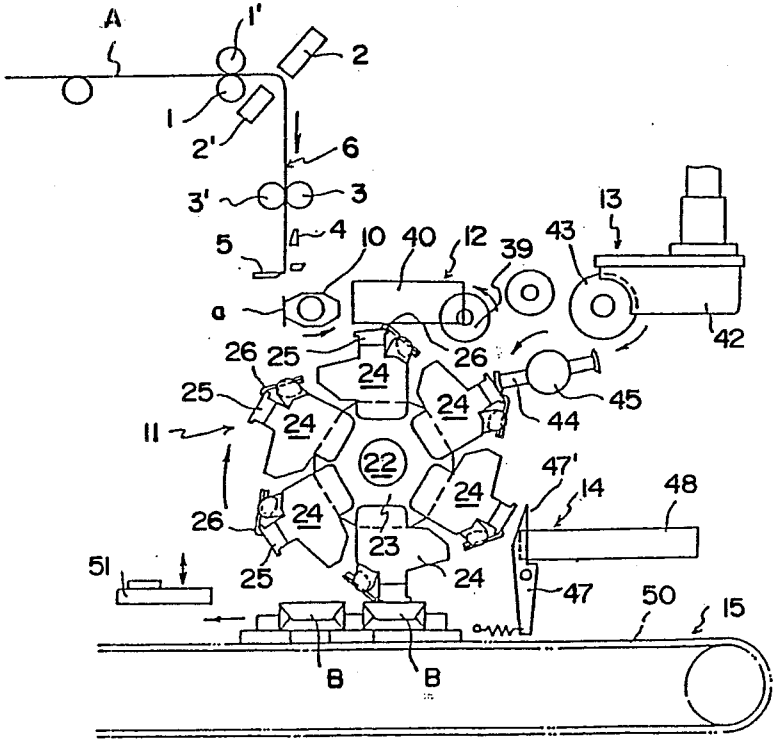
FIG. 1 is a side schematic view showing the main components of apparatus according to the present invention.
Figures 2, 3, 7:
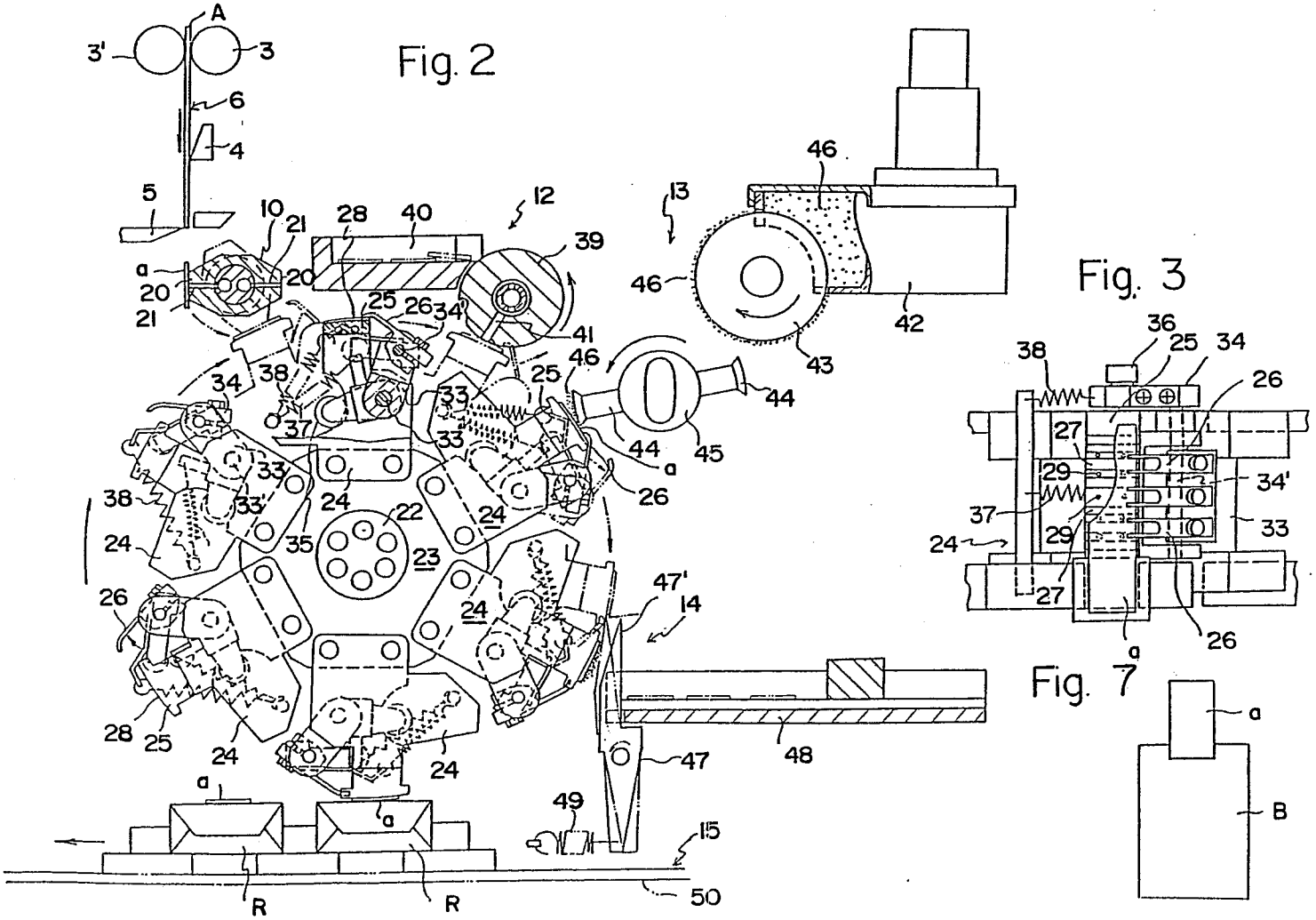
FIG. 2 is a side view with parts partially broken away showing details of the turret of the various stations of the present invention.
FIG. 3 is a top view of one of the stations shown in FIG. 2.
FIG. 7 is a plan view showing a seal strip attached to one side of a rectangular package and extending in the lengthwise direction of the package.
Figure 5:
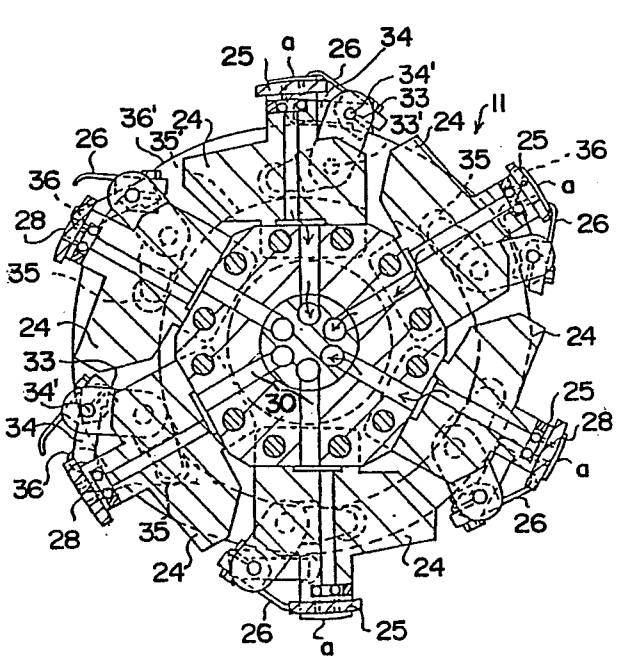
FIG. 5 is a sectional view taken along the line V—V of FIG. 4.

Referring now to the drawings, reference character A in FIG. 1 designates a seal-strip web that is to be severed into seal-strip segments a and applied, seriatum, to package B (as shown in FIG. 7) that pass along conveyor 15 of a packaging line. Web A passes through preliminary delivery rollers 1, 1', between photodetector 2, 2', and along a predetermined path 6 defining a delivery passage to cutter 5. Web A is provided with regularly spaced slits (not shown) that are transverse to the direction of movement of the web. The slits cooperate with feed claw 4 which is intermittently moveable in a periodic manner to continuously draw web A into cutter 5 which serves as means for periodically severing the moving web to produce individual seal-strip segments a which are supplied, seriatum, to transfer element 10. The operation of delivery roller 1, 1' and 3, 3' is coordinated with the output of photodetector 2, 2' such that the slits are aligned with the blade of cutter 5 when the latter is actuated so that severing of the web occurs along a slit. As a consequence, each seal strip segment a is rectangular in shape and has opposite surfaces.

As seen in FIG. 2, transfer elements 10 is mounted for rotation in a clockwise direction. During its rotation, the transfer element periodically moves between a receiving position, shown in solid lines in FIG. 2 for receiving a segment severed by cutter 5, and a transfer position shown in chain lines for transferring the segment. The transfer element is provided with holder surfaces 20 which are connected by suction ports 21 to a vacuum whereby one surface of segment a is releasably held in engagement with holder surface 20. As a consequence of this arrangement, segment a is held to the transfer element as the latter rotates from its receiving position to its transfer position.

As shown in FIG. 1, the apparatus according to the present invention also includes rotatable turret 11 comprising rotatable shaft 22 to which circular body 23 is attached, and a plurality of stations 24 at equal angular positions arranged about body 23 which rotates about the the axis of shaft 22, such axis being parallel to the axis about which element 10 rotates. Each station 24 includes support surface 28 (see FIG. 2) for supporting a segment where it is transferred thereto by transfer element 10. Means are provided for rotating turret 11 in synchronism with movement of element 10 such that, during one revolution of the turret, a different one of the stations is operatively associated with transfer element 10 each time the latter moves to its transfer position.

Each station includes holding means described in detail below made effective, when a station is operatively associated with the transfer element, for effecting a transfer of a segment from the transfer element to the station such that the other surface of the segment is held in contact with the support surface of the station and the one surface of the segment is exposed. As turret 11 rotates in the direction of the arrow as shown in FIGS. 1 and 2, the stations pass adhesive applicator 13 which applies adhesive to the exposed surface of a segment held at the station. Finally, continued movement of the turret brings a station carrying a segment with adhesive on the exposed surface thereof into tangential contact with package B for adhering the segment held on the station to the package. The result is shown in FIG. 7 where seal a is adhered to one surface of package B at one axial end thereof. Further, movement of conveyor 50 carries packages B beneath heater 51 which serves to cure the adhesive, thus securely bonding the segment to a package.

Referring again to FIG. 1, two systems are illustrated for removing defective seals from the stations in order to prevent their application to packages B. The primary system for removing defective seals is indicated by reference numeral 12, and the secondary system for removing defective seals is indicated by reference numeral 14.

Figure 4:
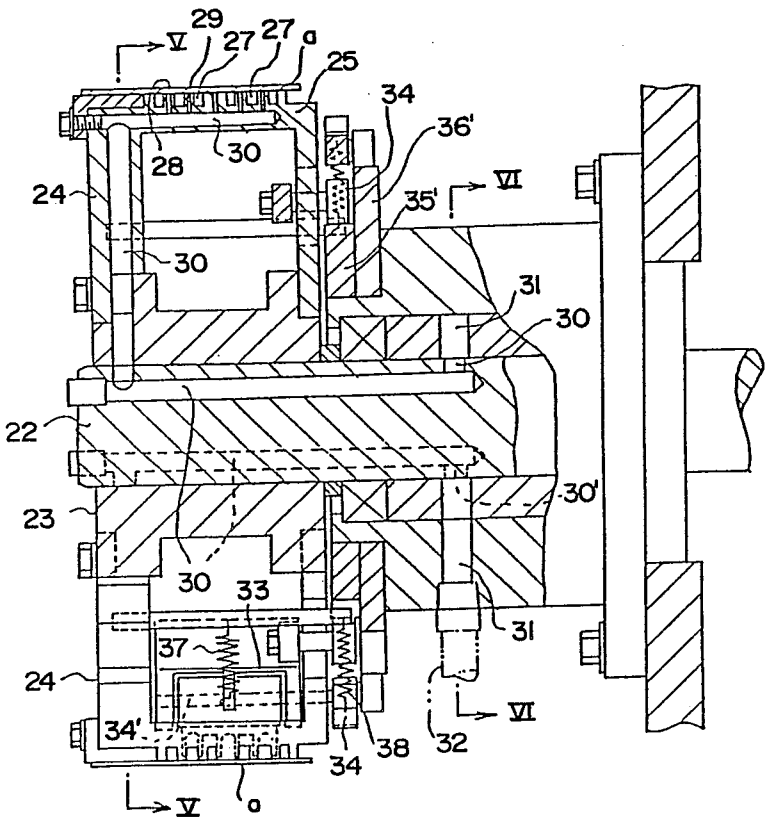
FIG. 4 is a sectional view taken along the line IV—IV of FIG. 2.
Figure 6:
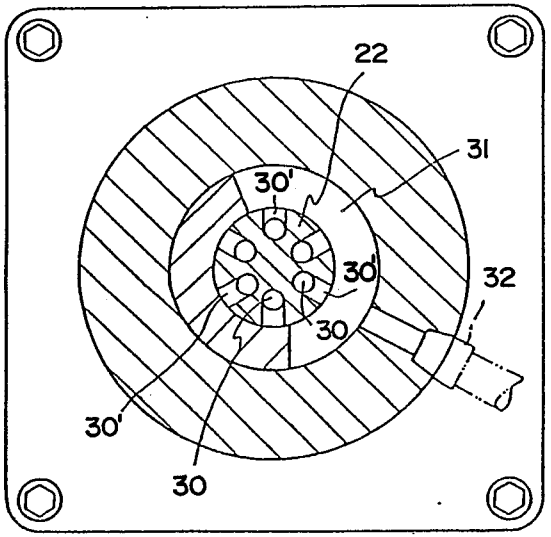
FIG. 6 is a sectional view taken along the line VI—VI of FIG. 4.

As shown in FIGS. 3 and 4, each station 24 is provided with support surface 28 having a plurality of axially spaced circumferential grooves 27. The lands of these grooves contain radially directed suction ports 29 which open to holding surface 28 and are connected by suction passage 30 (see FIG. 4) in body 25 of each station. Suction passage 30 passes radially through station 24 to mounting shaft 22 and then axially within the shaft to inside ends 30'. The inside ends are connectable to stationary suction chamber 31 (see FIG. 6) which is connected by suction hose 32 to a vacuum. As shaft 22 rotates turret 11, ends 30' sequentially open into suction chamber 31 and then are closed as shown in FIG. 6. As a consequence of this arrangement, suction is applied through ports 29 to support surface 28 while turret 11 moves through a predetermined angular displacement. Suction is thus applied to support surface 28 of each station just prior to its arrival to its operative association opposite transfer roll 10 (as shown by the chain lines in FIG. 2) until just after that station has tangentially engaged package B as turret 11 rotates.

The suction created by the alignment of ends 30' of the suction chamber with suction chamber 31 constitutes what is determined herein a first means for holding a segment to support surface 28. The present invention provides a second means for holding the segment to the support surface of a station, and these means are constituted by gripper finger 26. Specifically, the second means for holding a segment to a station comprises bell crank 33 pivotably mounted on rod 33' attached to circular body 23. This crank is resiliently urged in a clockwise direction as viewed in FIG. 2 by spring 37. Gripper finger 26 is rigidly attached to shaft 34' which carries lever 34 rigidly connected thereto at one end. Shaft 34' is rotatably mounted in one leg of bell crank 33. The other leg of the bell crank carries cam follower 35 which is engaged with cam surface 35' that is fixed with respect to shaft 22.

The free end of lever 34 carries cam follower 36 engaged with cam surface 36' that is fixed with respect to shaft 22. Follower 36 is urged into engagement with surface 36' by spring 38. Thus, both gripper finger 26 and bell crank 33 are resiliently urged in a clockwise direction as seen in FIG. 2.

The free end of gripper finger 26 on each station is comb-like in that a plurality of tips spaced axially across surface 28 are provided as shown in FIG. 3. These tips are spaced in alignment with grooves 27 allowing the tips to enter into these grooves upon appropriate pivotable movement of the spring finger 26 and bell crank 33 caused by the interaction between cam surfaces 36' and 35' and cam followers 36 and 35. These surfaces permit gripper finger 26 to have essentially three positions: an open position, a closed position, and a retracted position. In its open position, gripper finger 26 projects upwardly as shown by the chain lines in FIG. 2 so that the tips of the gripper finger clear holding surface 28 of a station. In this position, the tips effect engagement of the other surface of a segment on transfer element 10 with support surface 28 of station 24 when the latter is opposite element 10. In its closed position, the gripper finger is positioned such that the tips overlie the support surface of the station. The contour of cams 35' and 36' are such that the gripper finger is moved to its closed position immediately after the turret has been rotated to an angular position at which the other surface of a segment engages the support surface of the station. This is suggested by the arrow associated with the chain line in FIG. 2. Thus, the tips of the gripper finger of the station operatively associated with transfer element 10 resiliently engage the one surface of the segment and strips the same from the transfer element as the turret continues to rotate. In other words, the gripper finger mechanically engages and retains the segment to support surface 28 of a station overcoming the suction applied to the segment by suction ports 21 of the transfer element.

Once the segment has been stripped from the transfer element and captured by a station, gripper finger 26 can be moved from its closed to its open position. This is achieved by cam surfaces 35', 36'. The segment is held in contact with support surface 28 of a station by the suction applied by suction chamber 31.

The presence of a splice in web A will eventually result in producing a defective segment a; and the purpose of defective seal eliminating mechanism 12 is to remove the defective segment from turret 11. Removal of a defective seal is achieved by arranging for cam surfaces 35', 36' to move gripper finger 26 of a station to its open position as the station begins to approach roll 39 of mechanism 12. Roll 39 is provided with suction port 41, the roll being tangent to support surface 28. When a defective segment is detected, mechanism 12 is actuated by causing roller 39 to rotate until port 41 is opposite a station as the turret rotates the station past the roll. Because gripper finger 26 is in its open position, the defective segment carried by a station can be removed from the station and deposited, by rotation of roll 39 into container 40.

After a station passes beyond roll 39, it approaches adhesive application station 13 which comprises container 42 holding adhesive 46 which is deposited on the periphery of roller 43 as the latter rotates. Station 13 also includes rotatable shaft 45 carrying opposite brushes 44 which tangentially engage the surface of roller 43 effecting the transfer of adhesive 46 to the brush. Further, rotation of shaft 45 brings this brush into tangential contact with the other surface of segment a held on support surface 28 of a station as the latter passes the brush. Cam surfaces 35' and 36' are arranged such that gripper finger 26 is moved to its open position so as not to interfere with the application of adhesive to the segment.

In the event that the primary defective seal eliminating mechanism 12 has failed to eliminate a defective seal, secondary mechanism 14 is available as the station passes thereby. Station 14 includes a pivotably mounted arm 47 on the free end of which are provided comb-like tips 47' aligned with grooves 27 in the body 25. Spring 49 normally biases tips 47' out of operative engagement with grooves 27. When a station having a defective seal passes mechanism 12, lever 47 is pivoted clockwise as shown by the chain lines in FIG. 2 until tips 47' are positioned to enter grooves 27 in the station as the latter rotates past the tips.

To provide clearance for tips 47' of lever 47, gripper finger 26 can move to a retracted position within grooves 27 as shown in FIG. 2. In its retracted position, the tips of finger 26 lie below support surface 28 of a station and clear of tips 47' when lever 47 is actuated to rotate tips 47' into grooves 27. When this occurs, the tips 47' are effective to strip the defective seal from the station and deposit the same in container 48.

If the station contains a seal that is not defective and has not been removed by either mechanism 12 or mechanism 14, the station will carry the segment with the adhesive on the outer surface thereof around to a position at which the station is tangent to package B on conveyor 50 of line 15. The continuous movement of conveyor 50, and the continuous movement of packages B thereon, is synchronized with rotation of turret 11 such that each station contacts a package as the turret is rotated and the package is moved linearly on conveyor 15.

In operation, segments a are fed, seriatum, from cutter 5 to transfer element 10 the rotation of which is synchronized with the operation of cutter 5. The application of suction to suction port 21 in the transfer element causes one surface of segment a to adhere to the transfer element. Rotation of the transfer element and the direction indicated by the arrow in FIG. 2 moves element a into opposition with a station as turret 11 rotates and the other surface of the element engages surface 28 of the station. Suction is applied to ports 29 just prior to the arrival of the station opposite transfer element 10 by reason of the location of opening 30' associated with this station to suction chamber 31. At the same time, cam followers 35, 36 in cooperation with cam surfaces 35' and 36' are effective to move finger 26 of the station into a closed position thereby ensuring the transfer of a segment to the station. The mechanical engagement of the tips of finger 26 with the segment is interrupted as the station passes roll 39. If a defective segment has been detected, delayed operation of mechanisms 12 and 14 is initiated. In addition, roll 39 is rotated until suction port 41 is aligned with the station as the latter passes roll 39 thereby removing the defective segment from the station. In order for this removal to occur, the suction force developed by suction port 41 must overcome the forces developed by suction port 29 at the station. In case the defective segment is not removed, lever 47 is actuated when the station carrying the defective segment passes the second mechanism 14 allowing the tips 47' to project into grooves 27 thereby stripping the defective segment from the station. Thus, the operation of roller 39 and the actuation of lever 47 occurs in response to detection of a defective segment, the actuation of lever 47 occuring in timed relationship to the operation of roller 39 in order for tip 47' to be operatively associated with the station that contains the defective segment if it were removed by mechanism 12, or with the defective segment itself if mechanism 12 was unsuccessful in removing the segment.

If no defective segment is detected, the station passing roll 39 retains the segment and moves opposite adhesive application station 13 where adhesive is applied to the exposed surface of the segment. Mechanism 14 is not acutate as the segment passes thereby; and finally, the station tangentially contacts package B adhering the segment to the package. Conveyor 50 carries the package to which the segment is attached into engagement with heater 51 thereby securely attaching the segment to the package.

The advantages and improved results furnished by the apparatus of the present invention are apparent from the foregoing description of the preferred embodiment of the invention. Various changes and modifications may be made without departing from the spirit and scope of the invention as described in the claims that follow.

We claim:

1. Apparatus for attaching seal-strip segments to individual packages where said segments are in the form of a strip having opposed surfaces, said apparatus comprising:

(a) a transfer element movable periodically between a receiving position for receiving a segment from a supply thereof, and a transfer position for transferring the segment, said transfer element including means for releasably holding a segment with one surface thereof in contact with said element;

(b) a rotatable turret having a plurality of stations at equal angular positions about the axis of rotation of the turret, each station having a support surface for supporting a segment;

(c) means for rotating said turret in synchronism with movement of said transfer element such that, during one revolution of said turret, a different one of said stations is operatively associated with said transfer element each time the latter moves to its transfer position;

(d) holding means in each station made effective when the latter is operatively associated with said transfer element for effecting a transfer of a segment from said transfer element to a support surface such that the other surface of the segment is held in contact with the support surface of the station and the one surface of the segment is exposed; and (f) an adhesive applicator for applying adhesive to the one surface of the segments held by the station;

(g) said turret having an angular position at which a surface of a package tangentially contacts a station for adhering the segment held thereon to the package;

(h) said transfer element being rotatable and having a holding surface that faces a station on the turret when the element is in its transfer position, said means for releasably holding a segment being suction means connected to said holding surface, said element being constructed and arranged so that the holding surface is essentially tangent to the support surface of a station when the element is in its transfer position so that the other surface of a segment in contact with said holding surface, overlies the support surface of the station, the holding means of the station being constructed and arranged to mechanically engage the segment and hold the same against the support surface thereby stripping the segment from the transfer element as the turret and the transfer element rotate simultaneously.

2. Apparatus for attaching seal-strip segments to individual packages where said segments are in the form of a strip having opposed surfaces, said apparatus comprising:

(a) a transfer element movable periodically between a receiving position for receiving a segment from a supply thereof, and a transfer position for transferring the segment, said transfer element including means for releasably holding a segment with one surface thereof in contact with said element;

(b) a rotatable turret having a plurality of stations at equal angular positions about the axis of rotation of the turret, each station having a support surface for supporting a segment;

(c) means for rotating said turret in synchronism with movement of said transfer element such that, during one revolution of said turret, a different one of said stations is operatively associated with said transfer element each time the latter moves to its transfer position;

(d) holding means in each station made effective when the latter is operatively associated with said transfer element for effecting a transfer of a segment from said transfer element to a support surface such that the other surface of the segment is held in contact with the support surface of the station and the one surface of the segment is exposed; and (f) an adhesive applicator for applying adhesive to the one surface of the segments held by the stations;

(g) said turret having an angular position at which a surface of a package tangentially contacts a station for adhering the segment held thereon to the package;

(h) said holding means at each station including first means for selectively applying suction to said support surface to thereby releasably retain a segment on the support surface of the station, second means for selectively mechanically engaging the segment and retaining the same on the support surface, and control means for separately controlling first and second means as a function of the angular position of said turret.

3. Apparatus according to claim 2 wherein said control means include a suction passage that is connected to said first means during movement of said turret from an angular position at which a particular station is operatively associated with said transfer element to an angular position at which said particular station tangentially contacts a package.

4. Apparatus according to claim 2 wherein said second means of the holding means of each station includes a gripper finger mounted thereon for movement to an open position at which said finger is clear of said holding surface, and to a closed position at which said finger overlies said surface, and wherein said control means includes cam means cooperable with the second means of the holding means of each station for holding aid finger in open position to effect engagement of the other surface of the segment on the transfer element with the support surface of the station when the latter is operatively associated with said transfer element.

5. Apparatus according to claim 4, wherein said cam means is constructed and arranged to move the gripper finger of a member to its closed position immediately after the surface of a segment engages the support surface of the station thereby causing the gripper finger to engage the one surface of the segment and strip the same from the transfer element.

6. Apparatus according to claim 5 wherein the gripper finger of a station is mounted thereon such that the finger is moveable to a retracted position radially inwardly of the support surface, and wherein said cam means is constructed and arranged to move the gripper finger of a station to its retracted position before the turret moves to the angular position at which a station tangentially contacts a package.

7. Apparatus according to claim 6 wherein said control means includes a suction passage that is connected to said first means during movement of said turret from an angular position at which a particular station is operatively associated with said transfer element to an angular position at which said particular station tangentially contacts a package.

8. Apparatus according to claim 2 wherein the second means of the holding means of each station comprises:

(a) a bell crank pivotably mounted on said turret and resiliently urged in one direction;

(b) a gripper finger pivotably mounted on said crank and resiliently urged in said one direction, said gripper finger terminating in a comb having a plurality of tips; and wherein said control means includes a cam follower on each bell crank and on each gripper finger, and cam means operatively associated with the cam followers for moving the tips of a comb of a member to an open position at which said tips clear the holding surface of the station to effect engagement of the outer surface of a segment on the transfer element with the support surface of the member when the turret is positioned at an angle at which the station is operatively associated with said transfer element.

9. Apparatus according to claim 8 wherein the holding surface of each member has axially spaced circumferential grooves that match the tips on the combs of the station, said tips being biased towards said grooves.

10. Apparatus according to claim 9, wherein said cam means is constructed and arranged to effect movement of the tips of the comb of a station to a closed position at which said tips overlie the support surface on the station immediately after the turret has rotated to an angular position at which the other surface of a segment engages the support surface of the station thereby causing the tips to resiliently engage the one surface of the segment and strip the same from said transfer element as the turret continues to rotate.

11. Apparatus according to claim 10 wherein the first means of the holding means of each station includes suction orifices in the support surface of the member, and said control means includes a suction passage that is connected to the suction orifices during annular rotation of the turret from an angular position at which a particular station is operably associated with said transfer element to an angular position at which said particular station tangentially contacts a package.

* * * * *

UNITED STATES PATENT AND TRADEMARK OFFICE

CERTIFICATE OF CORRECTION

PATENT NO. : 4,876,839

DATED : OCTOBER 31, 1989

INVENTOR(S) : S. HONDA et al.

It is certified that error appears in the above-identified patent and that said Letters Patent is hereby corrected as shown below:

column 1, line 6, change "related" to —relates—;
column 1, lines 16-17, insert —.— after "package";
column 1, line 35, change "to" to —of—;
column 1, line 63, change "there on" to —thereon—;
column 2, line 43, change "elements" to —element—;
column 2, line 61, change "the the" to —the—; and
column 7, line 67, i.e., claim 4, line 8, change "aid" to —said—.

Signed and Sealed this

Twenty-third Day of July, 1991

*Attest:*

HARRY F. MANBECK, JR.

*Attesting Officer*

*Commissioner of Patents and Trademarks*